United States Patent [19]

Faust

[11] 3,948,392

[45] Apr. 6, 1976

[54] PACKAGE HAVING INTEGRAL MEANS FOR CARRYING AND METHOD FOR MAKING THE SAME

[75] Inventor: Clifford C. Faust, Riverside, Ill.

[73] Assignee: Union Carbide Corporation, New York, N.Y.

[22] Filed: Feb. 8, 1974

[21] Appl. No.: 440,777

[52] U.S. Cl. ..... 206/432; 206/45.33; 206/497; 229/52 B; 229/DIG. 12

[51] Int. Cl.[2] B65D 5/46; B65D 65/16; B65D 71/00; B65D 85/62

[58] Field of Search ..... 206/432, 497, 45.33, 427, 206/526, 419; 220/94 A; 229/DIG. 12, 52 B, 54, 55; 215/1 C, 1 R; 53/14, 30 S

[56] References Cited

UNITED STATES PATENTS

| | | | |
|---|---|---|---|
| 261,851 | 8/1882 | Hollett | 229/55 |
| 2,196,185 | 4/1940 | Belcher | 229/54 R |
| 3,087,610 | 4/1963 | Kirkpatrick | 206/432 |
| 3,200,944 | 8/1965 | Rapata | 206/432 |
| 3,277,628 | 10/1966 | Harrison | 53/30 S |
| 3,308,997 | 3/1967 | Kelly | 220/94 A |
| 3,660,959 | 5/1972 | LaFleur | 53/14 |
| 3,695,426 | 10/1972 | Engelsberger | 229/DIG. 12 |

*Primary Examiner*—William T. Dixson, Jr.
*Attorney, Agent, or Firm*—Franklyn Schoenberg

[57] ABSTRACT

A package is provided comprising a plurality of articles having an upper end portion of smaller cross-section arranged in an abutting array of at least two rows and a flexible plastic film about and retaining said array of articles, said film having portions thereof infolded between the upper end portions of abutting articles of opposite ends of the array of articles whereby an integral reinforced finger grip is formed for grasping and carrying said package. Also provided is a method for making a package comprising enveloping an abutting array of articles, each article having an upper end portion of smaller cross-section, with a flexible plastic film and infolding and tucking portions of said film between the upper end portions of abutting articles at opposite ends of the array of articles whereby means for carrying said package is formed.

9 Claims, 12 Drawing Figures

PACKAGE HAVING INTEGRAL MEANS FOR CARRYING AND METHOD FOR MAKING THE SAME

The present invention relates to an improved package construction and more particularly to an improved multi-pack container construction having integral reinforced means for grasping and carrying the package.

Multi-pack carriers have become widely used in the packaging of products sold in individual containers such as cans, bottles and the like. In general, both the containers and the packages in which they are marketed are disposable. The expendibility of the package makes the cost thereof especially important, yet there should be no sacrifice in package appearance, strength, protection for the containers in the package or the ease for carrying and use.

It is common practice for the packages to be made up to include a handle or other means to facilitate carrying the package. Multi-pack carriers of carton-board box structures having a central handle are widely used but the cost thereof is quite high. Plastic sheet carriers have achieved success in the multi-packaging of beverage cans but the standards for containers such as bottles require that the containers be held and retained in such a manner in the package that they will not be subject to breakage during handling thereof. Heat-shrinkable plastic film that shrinks about members disposed within the film to tightly compact the articles together in a predetermined arrangement has also been successfully employed in formation of packages of containers such as cans. However, when means, such as finger holes and the like, are incorporated in the film package for grasping and carrying the package, a film thickness of 0.003 to 0.005 inches or even thicker is needed to prevent the film from tearing or supplementary reinforcing means must be employed.

There have been several recommendations as to multi-packaging devices for containers such as glass bottles, some examples of which are shown in U.S. Pat. Nos. 3,084,792; 3,086,651; 3,330,408; 3,400,810; 3,504,790; 3,541,753. In general, the multi-pack constructions that are known have been found to be satisfactory for particular applications but are complex and expensive to produce and are generally limited as to the sizes and types of containers that may be packaged.

In accordance with the present invention, there is provided a package comprising a plurality of articles each having an upper end portion of a smaller cross-section arranged in a substantially abutting array of at least two rows and a flexible plastic film about and retaining said array of articles, outer or upper corner portions of said film being infolded between the upper end portions of abutting articles at opposite ends of the array of articles and preferably having overfolded portions of the infolded plies of said film fused together whereby reinforced finger grips are formed for grasping and carrying said package.

There is also provided in accordance with the present invention a method for preparing a package of articles comprising (a) arranging a plurality of articles each having an upper end portion of smaller cross-section in an abutting array of at least two rows; (b) enveloping and retaining said array of articles with a flexible plastic film, the edges of said film extending beyond said array of articles; and then (c) infolding and tucking outer or upper corner portions of said plastic film between the upper end, small cross-section portions of abutting articles at opposite ends of the array of articles whereby a reinforced finger grip is formed between the upper end portions of said array of articles for grasping and carrying the package. Preferably the plastic film is heated to shrink the same about the articles in said array and it is especially preferred to fuse the puckered or overfolded portions of infolded plies of film together.

The method of the present invention is suitable for readily assembling a plurality of articles, such as, for example, containers of various types including glass and plastic bottles and paper cartons, into an attractive stabilized multi-pack construction having a reinforced integral gripping and carrying means that will not separate from the package, wherein the containers are generally protected from damage, and that may be prepared without preformed spacers or support members for the articles or the need for supplementary carrying means, although separating means may be used where desired for certain applications.

The package of the present invention is of simple and economical construction that may be prepared using flexible plastic film as thin as 0.001 inches yet is strong and protects articles packaged therein. There is provided reinforced integral means for grasping and carrying the package and, in the case of particularly preferred embodiments, a package that is suitable for retaining and carrying articles after one or more of the original article members have been removed. Further, using a transparent plastic film for the package may eliminate the need for additional advertising printing; and articles of a wide variety of sizes, weights and shapes assembled in varying arrays may be packaged.

In view of the wide variety of sizes and shapes of articles that may be packaged in accordance with the practice of the present invention, the configuration defining the upper end portion of the articles may likewise vary widely in shape and proportion defined thereby. As employed throughout this specification and in the appended claims, it should be understood that the term "neck portions" is intended to define the "upper end portion of smaller cross-section" of many of the articles generally referred to as containers that are advantageously employed in the package of the present invention.

The package and method of the present invention will become apparent from the following description thereof when considered together with the accompanying drawing which is set forth as being exemplary of various embodiments of the present invention and is not intended, in any way, to be limitative thereof and wherein.

Figure 1:
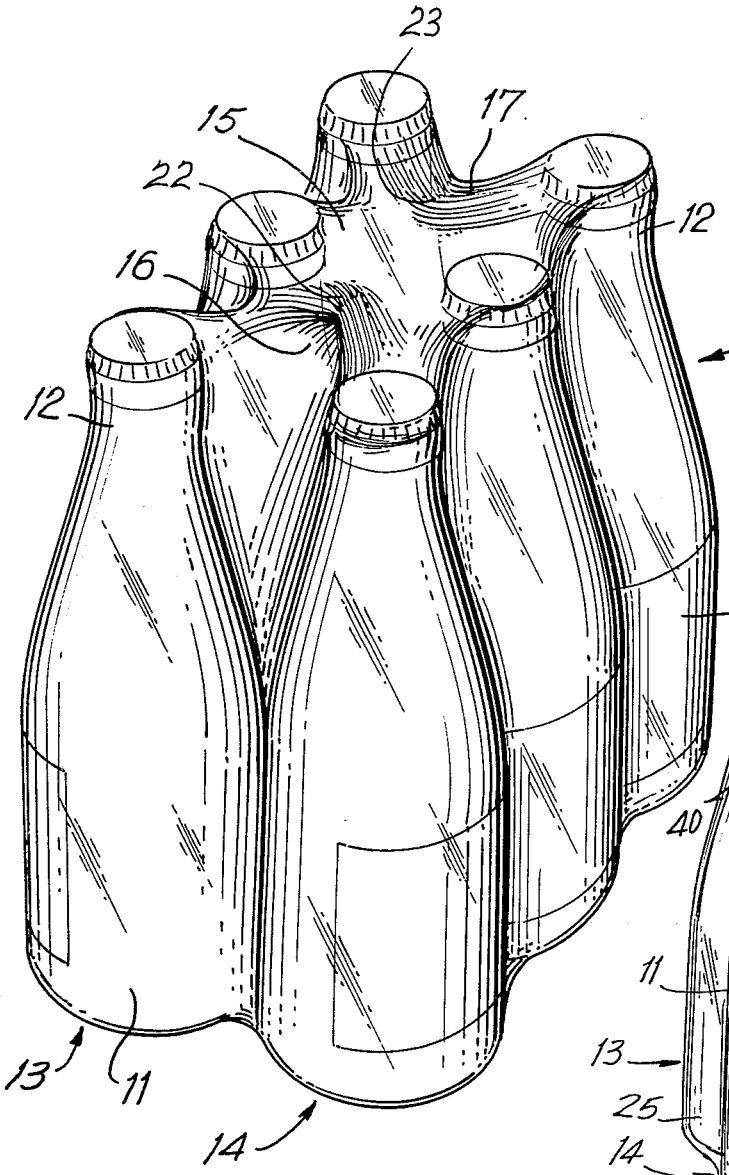
FIG. 1 is a perspective view of an exemplary embodiment of the package construction of this invention.

Turning now to the drawing wherein like reference numerals denote like parts, there is shown in FIG. 1 an exemplary embodiment of the improved package construction of the present invention designated generally as 10. The package may include a plurality of containers, such as the six bottles designated as 11, each of which has a neck defining its upper end portion designated as 12. Containers having a wide variety of sizes and shapes may be used as, for example, where the major or lower portion cross-section has a circular, oval, rectangular, hexagonal and the like configuration and a neck 12 defining the upper end portion that may be tapered, conical, cylindrical, tubular or a combination of like configurations of smaller cross-section than the major cross-section and may form a relatively short portion of the container or define a substantial portion thereof. Suitable containers may be, for example, glass or plastic bottles such as used with beer, other beverages, and food and paper cartons such as used with milk and the like.

The plurality of containers, such as the six glass bottles 11, may be assembled in any desired manner as, for example, in an array of two abutting rows shown generally as 13 and 14, or in other arrangements which may be more suitable for the size, weight and number of containers to be included in the package.

A flexible plastic film 15 closely envelops and is preferably heat-shrunk about the containers 11 retaining and supporting them to provide a strong package 10 which is of simple and economical construction and can be readily prepared. The plastic film, which may be translucent, opaque or preferably transparent, may be prepared from any one of a variety of well known film-forming polymers as, for example, polyvinylchloride, polyethylene, polyvinylidene chloride, polypropylene and the like. The thickness of the plastic film may be about 0.001 inch to 0.003 inch or greater depending on the size, weight and conformation of the container items to be packaged.

Preferably, a heat shrinkable plastic film is employed in preparing the package of the present invention so the film may be tightly drawn about the array of containers to retain them more securely. However, any flexible film that will closely envelop the array of articles as, for example, film having elastic properties may be advantageously employed.

It is important that portions of said film are infolded and tucked between the neck portions 12 of abutting containers 11 and preferably between the neck portions 12 of abutting containers at opposite ends of the array thereof, thereby forming reinforced, integral finger grip pockets 16 and 17 for grasping and carrying the package 10. Preferably, puckered or overfolded portions 22, 23 or the infolded plies of film are fused together to further reinforce the integral finger grip pockets 16 and 17 as illustrated in FIG. 1.

Figure 2:
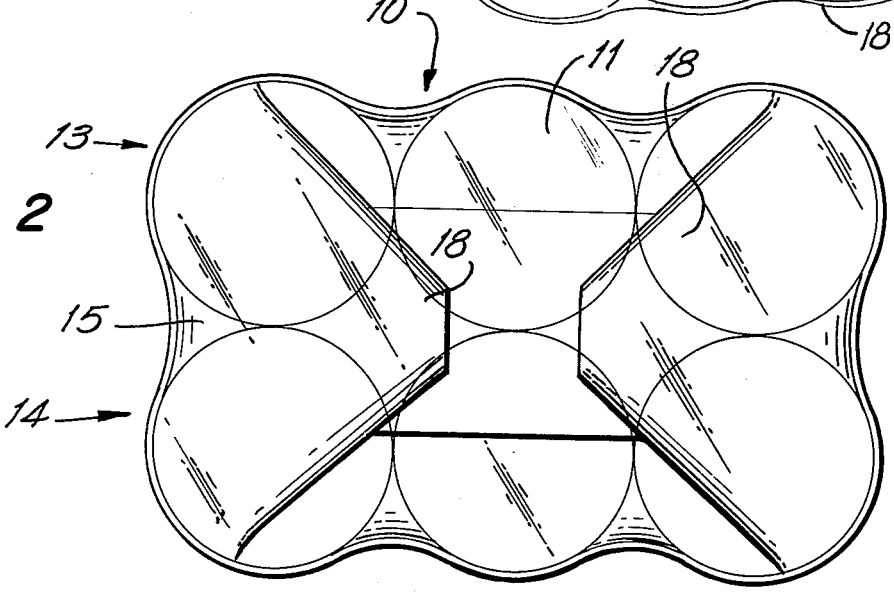
FIG. 2 is a bottom view of the package illustrated in FIG. 1.

The flexible plastic film 15 of package 10 completely envelops the array of containers, end portions 18 of said film 15 having been overlapped and fused at the bottom end of the array of bottles as illustrated in FIG. 2.

Figure 3:
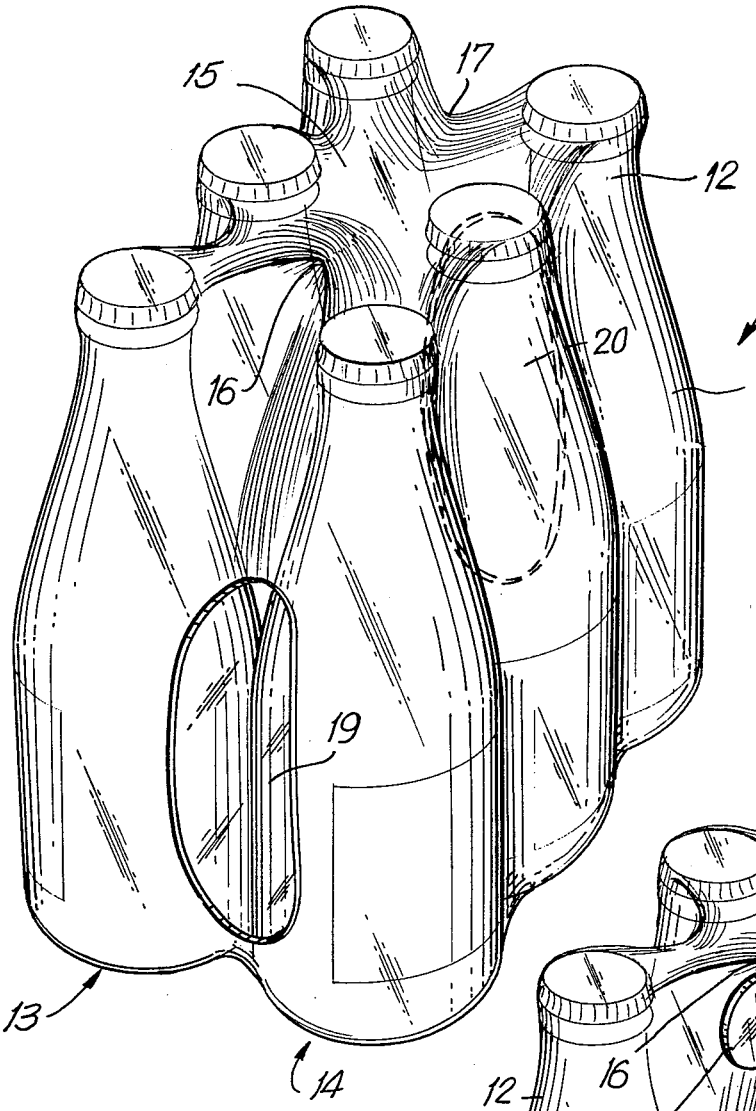
FIG. 3 is a perspective view of an exemplary embodiment of the package of this invention.
Figure 4:
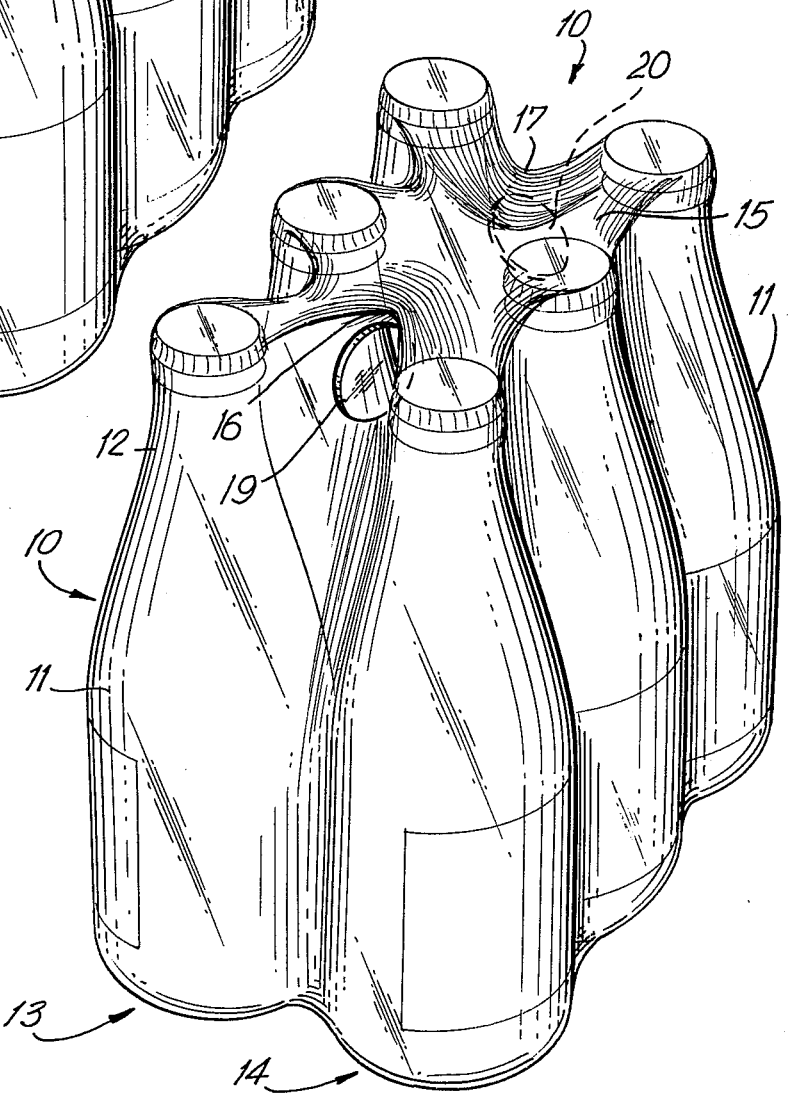
FIG. 4 is a perspective view of an exemplary embodiment of the package of this invention.
Figure 6:
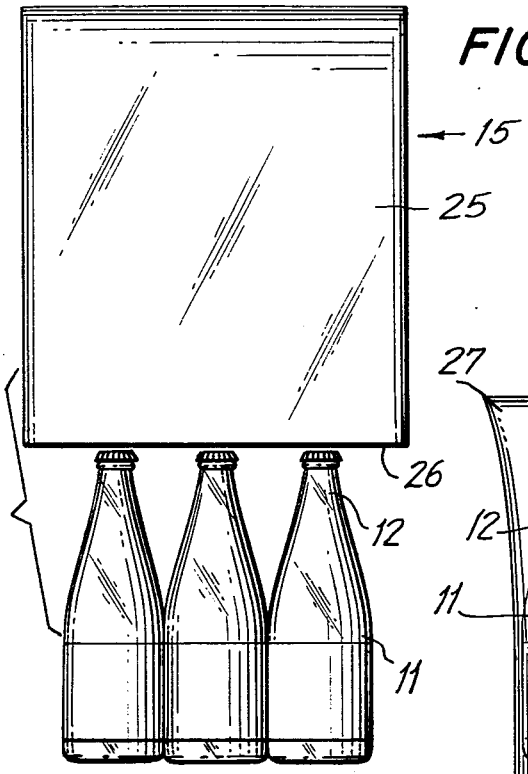
FIG. 6 is a side view showing the components of an exemplary package of the invention in unassembled position.
Figure 7:
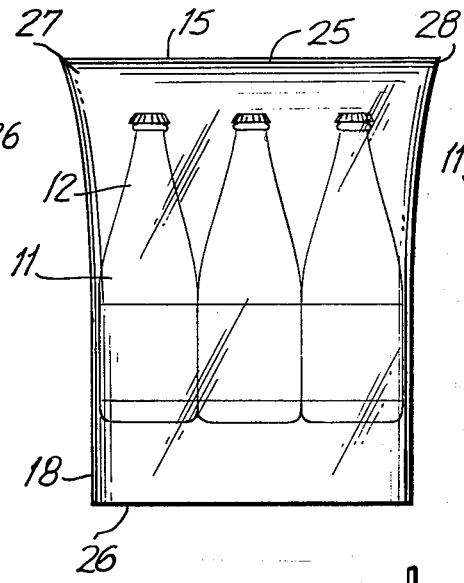
FIG. 7 is a side view showing the components of FIG. 6 in partially assembled position.
Figure 8:
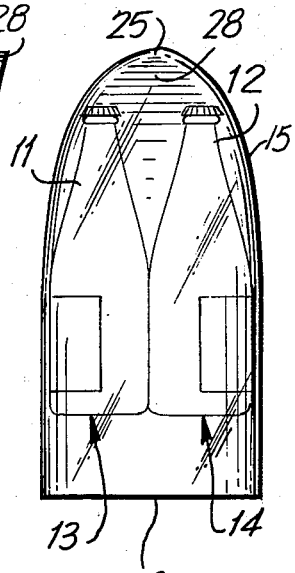
FIG. 8 is an end view of the components of FIG. 7.
Figure 9:
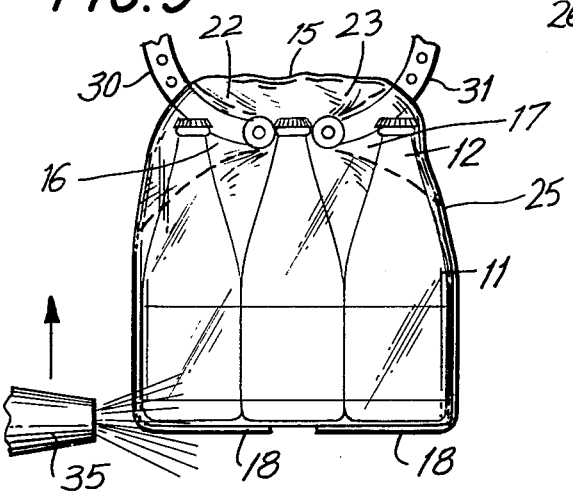
FIG. 9 is a side view illustrating the step of infolding and tucking the film between the abutting articles of FIGS. 6 to 8.
Figure 10:
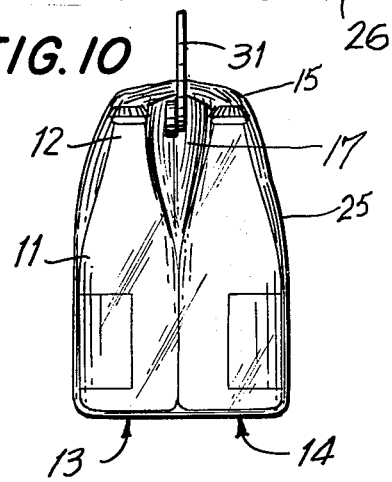
FIG. 10 is an end view of the components of FIG. 9.
Figure 11:
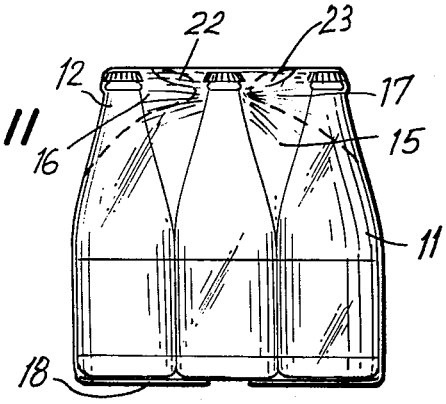
FIG. 11 is a side view illustrating the package prepared using the components and steps of FIGS. 6 to 10.
Figure 12:
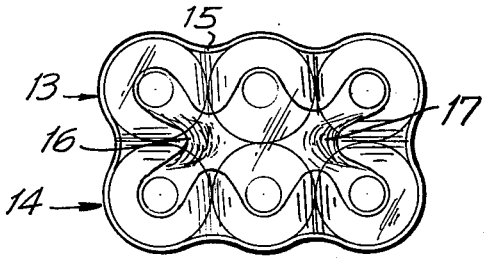
FIG. 12 is a plan view of the package illustrated in FIG. 11.

In FIGS. 3 and 4 are illustrated alternate embodiments of the package of the present invention. In FIG. 3 the film 15 having opposed openings therein, 19 and 20, is tightly drawn about the opposed side portions of the endmost containers, which after shrinking result in stretched apertures indicated at 19 and 20. In FIG. 4 opposed openings 19 and 20 are provided in the film adjacent the finger pocket 16, 17 area which after shrinking result in stretched apertures indicated at 19 and 20 to further assist in grasping and carrying the package by the reinforced film finger grip pockets 16, 17. With the main exception being the openings in the film, the embodiments of the package illustrated in FIGS. 3 and 4 of the drawing are identical to the embodiment illustrated in FIG. 1. Therefore, the package of FIGS. 3 and 4 will be designated by the same number 10 and identical parts in the later embodiments will not be described again but will be shown on the drawing with the same numeral designations.

Figure 5:
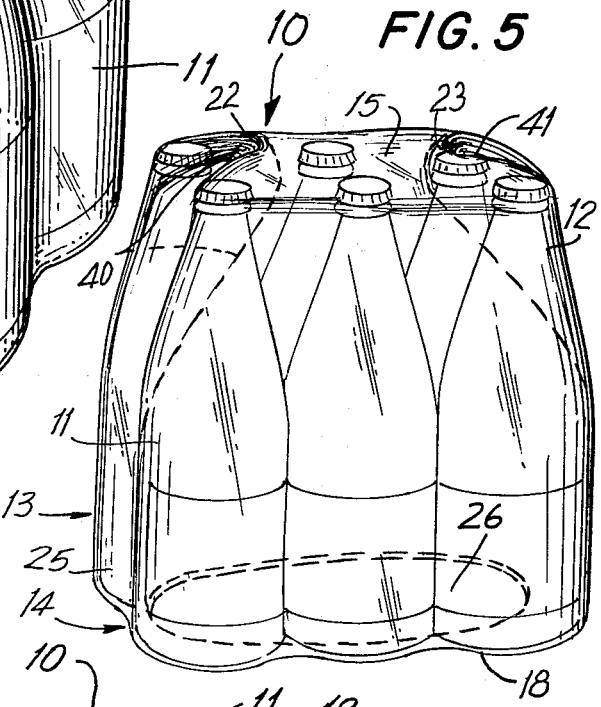
FIG. 5 is a perspective view of an exemplary embodiment of the package of this invention.

In FIG. 5 is illustrated another alternate exemplary embodiment wherein a preformed plastic film bag 25 having an open end 26 and opposite infolded or "gussetted" side walls, 40 and 41, closely envelops and retains six containers 11 arrayed in two abutting rows 13 and 14. The plastic film 15 employed in forming the bag 25 has elastic properties and grips the array of containers under tension. The bag 25 has an initial girth dimension less than the girth dimension of the array of containers and has been stretched open and drawn down over the top of the array of bottles to produce a package having a draped or loose portion of film encompassing the necks of the bottles while that portion of film 18 defining the open end of the bag is tightly drawn about and preferably completely envelops and is sealed about the bottom ends of the bottles 11 as illustrated in FIG. 2. The opposite infolded side walls, 40 and 41, (FIG. 5) are disposed between the abutting containers at the opposite ends of the array of containers to form reinforced integral finger grip pockets for grasping and carrying the package.

A method for forming the package construction of the present invention as, for example, package 10 of FIGS. 1 and 2 will now be described and reference is made to FIGS. 6 to 12.

Six 12 oz. beverage bottles 11 are arranged in an array comprising two abutting rows 13 and 14. A flexible plastic film 15 preformed into a flat bag 25 having an open end 26 is draped over the top of the array of bottles and then arranged so as to completely envelop the array of bottles with the film 18 defining the open end 26 of the bag 25 extending below the bottom ends of the bottles while leaving some slack between the closed end of film bag 25 and the tops of said bottles. End portions 18 of the film defining the open end 26 of the bag 25 are folded and overwrapped across the bottom ends of the array of bottles 11 and fused using conventional heat sealing means or alternatively adhesively bonded.

A pair of cooperating mandrel fingers 30 and 31 are urged downwardly toward the array of bottles engaging the outstanding opposite top corner portions 27 and 28 of the film bag 26 infolding and tucking the film between the necks 12 of abutting bottles 11 at opposite ends of the array of bottles. The mandrel fingers 30 and 31 are traversed inwardly and towards each other between the necks 12 of bottles 11 to infold top corner portions of the film, forming pockets 16, 17 having puckers or small overlying folds 22, 23 in the top of the infolded portions of the film bag, until arriving at a desired spacing therebetween for providing a convenient finger grip span of, for example, about 2 to 2½ inches.

A blast of hot air from the "shrink gun" 35 is then directed over the entire exposed surface of film bag 25 causing the film to shrink and draw tightly about the containers 11 and preferably fusing together the overlying folds 22, 23 of the infolded plies of film retained by mandrel fingers 30 and 31. Alternatively, the partially completed package construction may be passed through a heating chamber of the like wherein the heat causes heat shrinking of the film and the fusing together of the puckers 22, 23 of the infolded plies of film while the fingers 30, 31 are maintained at the desired grip span spacing. After the film cools, the mandrel fingers 30 and 31 are withdrawn from within the formed pockets of film, 16 and 17, between the necks 17 of containers 11. The infolded pockets of film, 16 and 17, form integral, reinforced finger gripping means for grasping and carrying the package 10, and the package prepared as described above can be readily grasped and carried without damage to the film 15 or articles 11 retained therein.

Flexible plastic film formed into a number of alternate configurations may be suitable for use in assembly of the package of the present invention. For example, preformed bags having infolded side walls such as in "gussetted bags" or preformed tubing or sleeves may also be readily and advantageously employed.

As is obvious, alternative methods may be advantageously employed in forming the package of the invention in accordance with the practice of the invention.

An array of articles as, for example, the array of containers 11 illustrated in the drawings may be inserted into a preformed plastic film bag with the array of articles retained by the preformed closed end of the bag and the opposite open end thereof loosely draped about the upper end portions of said containers. The open end of the bag may then be sealed or partially sealed, for example, by heat sealing or adhesively bonding. Opposite top corner portions of the film may then be infolded between the neck portions of abutting containers at opposite ends of the array of containers and the plastic film may be heat shrunk about the containers and the puckered portions 22, 23 of the infolded plies of film fused together by application of heating means. When the open end of the bag is partially sealed, a package such as illustrated in FIG. 4 may be obtained.

Alternatively, a film tubing or sleeve may be draped about an array of articles with the film defining the opposed open ends of said tubing extending beyond the upper end portions and bottom ends of said articles. Mandrel fingers or other suitable means may be used to gather and infold portions of the film between the upper end or neck portions of the abutting articles at opposite ends of the array thereof and then upon application of heating means while retaining the mandrel in place, the plastic film can be heat shrunk, the film drawing tightly about the endmost articles and the tops and bottoms of the articles in the array, and preferably the puckered or overfolded portions of the infolded plies of film can, at the same time, be fused together forming integral reinforced finger grips for carrying the package.

Similarly, an array of articles may be arranged in a tubular sleeve of film with the opposite open ends of the film tubing extending beyond the endmost articles in the array. A suitable package may be formed by infolding portions of the film and then heat shrinking the film and fusing the puckered portions of the infolded plies thereof in the manner described herein to produce a package such as illustrated in FIG. 3.

The flexible plastic film as, for example, in the form of preformed bags or tubing as herein described, employed in assembling the package of the invention, may envelop the desired array of articles before heating so that the film is quite snug, or it can be fairly loose or it can be snug about certain portions of the articles and fairly loose about other portions of said array depending on the film material, the size, weight and shape of the articles and the desired array and the method to be used in preparing the package. In any event, there must be enough film material available to enable the film to be infolded between the upper end portions of smaller diameter of abutting articles at opposite ends of the array thereof, or, alternatively, when employing preformed bags having opposite infolded side walls, sufficient infolded film is provided to form reinforced integral finger grip pockets.

Accordingly, an array of articles as, for example, the array of containers 11 illustrated in the drawings may be enveloped with a closely fitting preformed film bag having opposite infolded side walls, the film material having elastic properties. The bag is arranged about the array of containers to retain the same with the infolded side walls positioned between the abutting containers at the opposite ends of the array and the film defining the open end of the bag extending and being tightly drawn about the bottom ends of said array of containers as illustrated, for example, in FIG. 5.

It has been found that the package of the present invention as, for example, a package of six, 12 oz. beverage bottles retained in a "shrinkable" polyethylene film 2 mils thick as illustrated in FIGS. 1 and 2, or of six, 16 oz. beverage bottles of similar construction, could be easily carried by grasping the package at the integral infolded finger grip pockets without damage to the film or articles retained therein. The package, when subjected to shock impact testing, performed as well as or better than packages using paperboard cartons. Further, it was found that after removal of one or two containers of the array in the package, the remaining containers were safely retained therein and the package could be grasped and carried without damage or loss of integrity thereof.

While in the foregoing specification embodiments of the invention have been set forth in considerable detail for purposes of making a complete disclosure thereof, it will be apparent to those skilled in the art that numerous changes may be made without departing from the spirit and principle of the invention.

What is claimed is:

1. A package of articles comprising a plurality of articles each having an upper end portion of smaller cross section arranged in a substantially abutting array of two rows and a flexible plastic film about and retaining said array of articles, said film having opposite upper portions infolded between the upper end portions of abutting articles at opposite ends of the array of articles forming two integral reinforced finger grip means for grasping and carrying said package.

2. The package of claim 1 wherein overfolded portions of said infolded film are fused together.

3. The package of claim 2 wherein said articles are containers.

4. The package of claim 1 wherein said film completely envelops said articles.

5. The package of claim 2 comprising an even number of articles.

6. A package of articles comprising a plurality of containers each having a neck defining the upper end portion thereof arranged in a substantially abutting array of two rows and a flexible plastic film bag having an open end that envelops and is tightly drawn about and retains said array of containers, and having the closed end of such bag opposite the open end drawn about the upper end portion of the containers in said array with opposite portions of the closed end and sides of said film bag being infolded between the neck portions of abutting containers at opposite ends of the rows of containers in said array forming two integral reinforced finger grip means for grasping and carrying said package.

7. The package of claim 6 wherein said flexible film is elastic.

8. The package of claim 6 wherein overfolded portions of the infolded film are fused together.

9. The package of claim 6 where said array of containers comprises an even number of containers.

* * * * *